US006880604B2

(12) United States Patent
Keene

(10) Patent No.: US 6,880,604 B2
(45) Date of Patent: Apr. 19, 2005

(54) BUTT SPLICER APPARATUS

(75) Inventor: John Keene, South Beloit, IL (US)

(73) Assignee: Keene Technology Inc., South Beloit, IL (US)

( * ) Notice: Subject to any disclaimer, the term of this patent is extended or adjusted under 35 U.S.C. 154(b) by 0 days.

(21) Appl. No.: 10/222,624

(22) Filed: Aug. 17, 2002

(65) Prior Publication Data

US 2003/0075276 A1 Apr. 24, 2003

Related U.S. Application Data

(63) Continuation-in-part of application No. 09/880,336, filed on Jun. 13, 2001, now abandoned.

(51) Int. Cl.[7] ..... B65H 21/00

(52) U.S. Cl. ..... 156/504; 156/304.3; 156/505; 242/554.1; 242/554.5; 242/556.1

(58) Field of Search ..... 156/304.1, 304.3, 156/502, 504, 505, 506, 507; 242/554.1, 554.5, 555.2, 556.1

(56) References Cited

U.S. PATENT DOCUMENTS 3,257,085 A * 6/1966 Riegger ..... 242/554.2
3,642,555 A * 2/1972 Nagoshi et al. ..... 156/505
3,719,542 A * 3/1973 Schmitz et al. ..... 156/502
5,656,125 A * 8/1997 Tanaka ..... 156/361
5,902,431 A * 5/1999 Wilkinson et al. ..... 156/159
5,925,214 A * 7/1999 Klein et al. ..... 156/556
5,935,371 A * 8/1999 Distefano et al. ..... 156/304.3

FOREIGN PATENT DOCUMENTS

JP 43-26681 * 11/1968 ..... 156/502
JP 61-136850 * 6/1986 ..... 156/506

* cited by examiner

*Primary Examiner*—Mark A. Osele
(74) *Attorney, Agent, or Firm*—David J. Archer

(57) ABSTRACT

A sleeve label splicer apparatus is disclosed for splicing together a tail end of a roll of sleeve labels to a leading edge of a replacement roll of sleeve labels. The splicer apparatus includes a drive roller for driving and guiding the roll of sleeve labels and a backing roller cooperating with the drive roller such that the drive and backing rollers define therebetween a nip for controllably positioning the tail end of the roll of sleeve labels relative to the leading edge of the replacement roll of sleeved labels. The arrangement is such that the tail end is disposed in abutting relationship relative to the leading edge of the replacement roll. A splicing tape applicator is provided for applying a splicing tape to front surfaces of the abutting tail end and leading edge. Also, a further splicing tape applicator is provided for applying a further splicing tape to back surfaces of the abutting tail end and leading edge.

12 Claims, 8 Drawing Sheets

BUTT SPLICER APPARATUS

CROSS REFERENCE TO RELATED APPLICATION

This application is a continuation-in-part of patent application U.S. Ser. No. 09/880,336 filed Jun. 13th, 2001 now abandoned. All of the disclosure of U.S. Ser. No. 09/880,336 is incorporated herein by reference.

BACKGROUND OF THE INVENTION

The present invention relates to a butt splicer apparatus. More specifically, the present invention relates to an apparatus for butt splicing a tail end of a roll of sleeve labels disposed in series relative to each other with a leading edge of a new roll of sleeve labels.

The application of individual sleeve labels to containers such as bottles or cans and the like involves the use of a sleeve label application machine. Such a sleeve label application machine typically includes a roll of sleeve labels with each sleeve label being equally spaced in series from an adjacent sleeve label.

More particularly, sleeve labels typically include a length of PVC film that is printed on one surface thereof with a series of identical printed matter which may include a picture, the name of the product and the name of the producer of the product. The film is then doubled over and seam sealed longitudinally to form an elongate sleeve. The elongate sleeve is then wound into a roll for subsequent application one at a time onto or around a product container such as a bottle or package. Additionally, the individual sleeve labels may be filled with further product information prior to application to the package or bottle.

However, in a high speed production line, when a roll of such sleeve labels must be replenished, it is necessary to attach a leading edge of a new roll of sleeve labels to a tail end of the exhausted roll. Such splicing of a new roll of labels according to the present invention, requires the attachment of a splicing tape to both the front and back surfaces of the rolls to be spliced together. If a splicing tape were to be applied to only one surface, there would be a strong tendency for the sleeve labels in the vicinity of the splice to pucker or open up so that the front and back layers of the sleeve label would open up or move apart prior to application. Nevertheless, when a splicing tape is applied to the front surface and another splicing tape is applied to the back surface of the rolls to be spliced, it is important that the distance between the tail end and the leading edge be minimal otherwise the adhesive from one splice tape will adhere to the adhesive of the splice tape applied to the opposite surface. In practice, it has been discovered that the distance between the adjacent edges of the leading edge of the new roll and the trailing edge of the old roll should not be more than 1/32 of an inch.

In order to achieve the aforementioned objectives, the splicer apparatus according to the present invention reduces the tension in the vicinity of the splice to almost zero during a splicing operation. Additionally, the splicer apparatus according to the present invention includes means for trimming any splicing tape overhang of more than 1/16 of an inch from the respective sides of the splicing tapes.

In the prior art machines, when the roll of sleeve labels was depleted, it became necessary to stop the labelling process in order to set up a new roll of labels into the labelling machine. Needless to say, modem production plants will ideally include a continuous production line with a minimum number of stops for maintenance. Although a roll of labels may last for 1–2 hours, it has been customary with the prior art machines for the production line to be stopped while a new roll of labels is threaded into the labelling machine.

The present invention overcomes the aforementioned problem of stopping a production line to replenish a roll of sleeve labels. More specifically, the present invention provides a butt splicer apparatus in which a new roll of sleeve labels is butt spliced to the tail end of the used roll.

The arrangement according to the present invention enables the splice tapes to be applied to both surfaces of the sleeve labels almost simultaneously. Accordingly, the application of the sleeve labels remains uninterrupted such that the production line can remain up and running.

Therefore, it is a primary feature of the present invention to provide a sleeve label butt splicer apparatus that overcomes the problems associated with prior art arrangements.

Another feature of the present invention is the provision of a butt splicer apparatus that enables application of sleeve labels without interruption.

Another feature of the present invention is the provision of a butt splicer apparatus that enables splicing of a leading edge of a new roll of sleeve labels to the tail end of a running roll of sleeve labels without stopping an application of the labels.

Other features and advantages of the present invention will be readily apparent to those skilled in the art by a consideration of the detailed description of a preferred embodiment of the present invention contained herein.

BRIEF SUMMARY OF THE INVENTION

The present invention relates to a sleeve label splicer apparatus for splicing together a tail end of a roll of sleeve labels to a leading edge of a replacement roll of sleeve labels. The splicer apparatus includes a drive roller for driving and guiding the roll of sleeve labels and a backing roller which cooperates with the drive roller such that the drive and backing rollers define therebetween a nip for controllably positioning the tail end of the roll of sleeve labels relative to the leading edge of the replacement roll of sleeved labels. The arrangement is such that the tail end is disposed in abutting relationship relative to the leading edge of the replacement roll. A splicing tape applicator is provided for applying a splicing tape to front surfaces of the abutting tail end and leading edge. Also, a further splicing tape applicator is provided for applying a further splicing tape to back surfaces of the abutting tail end and leading edge.

In a more specific embodiment of the present invention, the sleeve label splicer apparatus further includes a control mechanism for controlling rotation of the drive roller such that the tail end and leading edge are indexed relative to each other.

The sleeve label splicer apparatus also includes a festoon which is disposed downstream relative to the nip, the backing roller permitting the nip to isolate any tension generated by the festoon from the tail end and leading edge, which are indexed relative to each other, during application of the splicing tapes.

Furthermore, the tape applicator is disposed upstream relative to the nip and the further tape applicator is also disposed upstream relative to the nip. The arrangement is such that the tape applicator and further tape applicator apply the splicing tape and further splicing tape respectively substantially simultaneously to the tail end and leading edge which are indexed relative to each other.

Additionally, an idler roller is disposed in a vicinity of the tape applicators for guiding the tail end and leading edge which are indexed relative to each other. A first clamp collar is adjustably secured to the idler roller for guiding the indexed tail end and leading edge. Also, a second clamp collar is adjustably secured to the idler roller and spaced from the first collar for guiding the indexed tail end and leading edge. The idler roller is disposed upstream relative to the tape applicators.

A trimming mechanism is provided for trimming excess splicing tape from the abutting spliced rolls. More specifically, the trimming mechanism includes a first trimming knife for trimming a first side of the applied splicing tapes and a second trimming knife for trimming a second side of the applied splicing tapes.

Also, the tail end and leading edge are indexed such that the splicing tapes are applied to both the front and back surfaces of one of the sleeved labels so that when a sleeved label with splicing tapes applied thereto is applied to a product, only the product with that sleeved label applied thereto will require rejection.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Those skilled in the art will appreciate that throughout the subject application, the term "festoon" is to be understood as not only including an arrangement as illustrated in FIGS. 6 and 7 of the subject application but also to include any system for guiding the sleeved labels towards a sleeve applicator.

Furthermore, throughout the subject application, the term "simultaneously" and "substantially simultaneously" in connection with the application of the respective splicing tapes is to be understood to include the arrangement as shown in FIGS. 6 and 7 in which one of the splicing tapes is applied to the indexed sleeve labels downstream and therefore slightly later in time relative to the application of the other splicing tape.

BRIEF DESCRIPTION OF THE DRAWINGS

Similar reference characters refer to similar parts throughout the various views of the drawings.

DETAILED DESCRIPTION

Figure 1:
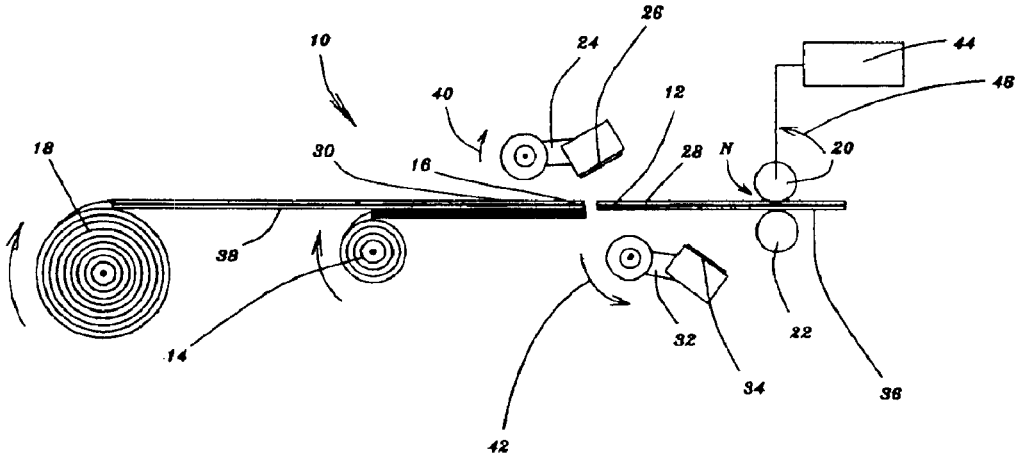
FIG. 1 is a diagrammatic representation of a sleeve label splicer apparatus according to the present invention for splicing together a tail end of a roll of sleeve labels to a leading edge of a replacement roll of sleeve labels.

FIG. 1 is a diagrammatic representation of a sleeve label splicer apparatus generally designated 10 according to the present invention for splicing together a tail end 12 of a roll 14 of sleeve labels to a leading edge 16 of a replacement roll 18 of sleeve labels. The splicer apparatus 10 includes a drive roller 20 for driving and guiding the roll 14 of sleeve labels and a backing roller 22 cooperates with the drive roller 20 such that the drive and backing rollers 20 and 22 define therebetween a nip N for controllably positioning the tail end 12 of the roll 14 of sleeve labels relative to the leading edge 16 of the replacement roll 18 of sleeve labels. The arrangement is such that the tail end 12 is disposed in abutting relationship relative to the leading edge 16 of the replacement roll 18. A splicing tape applicator 24 is provided for applying a splicing tape 26 to front surfaces 28 and 30 of the abutting tail end 12 and leading edge 16. Also, a further splicing tape applicator 32 is provided for applying a further splicing tape 34 to back surfaces 36 and 38 respectively of the abutting tail end 12 and leading edge 16.

Figure 2:
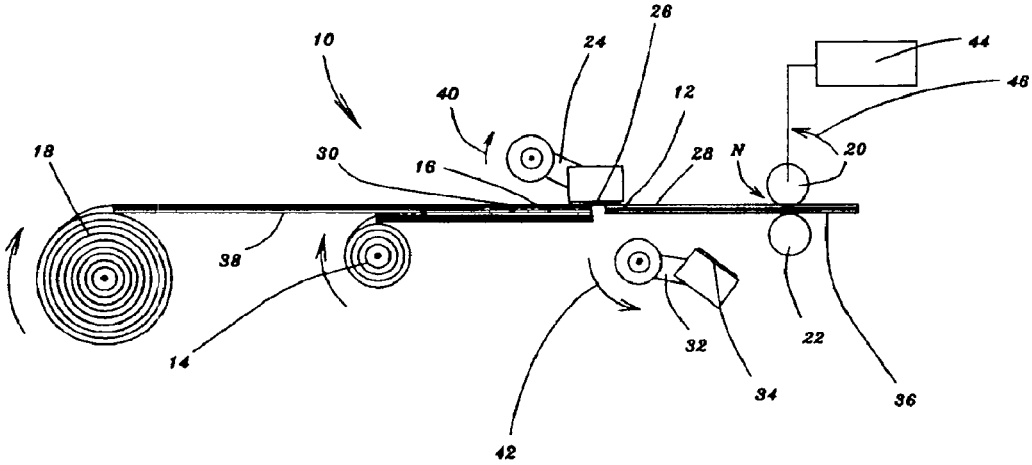
FIG. 2 is a similar view to that shown in FIG. 1 but shows the splicing tape applicator rotating so that the splicing tape is applied to the abutting tail end and leading edge.

FIG. 2 is a similar view to that shown in FIG. 1 but shows the splicing tape applicator 24 rotating as indicated by the arrow 40 so that the splicing tape 26 is applied to the abutting tail end 12 and leading edge 16.

Figure 3:
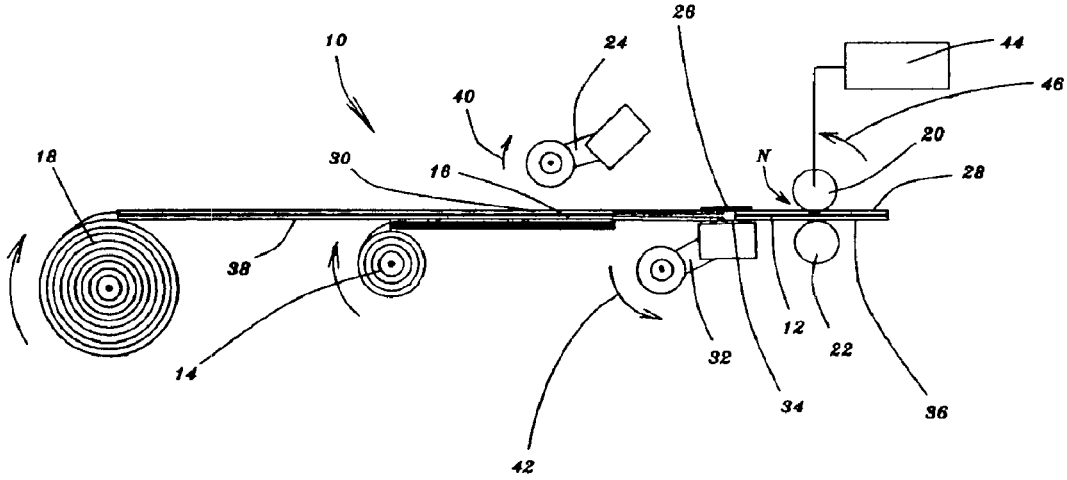
FIG. 3 is a similar view to that shown in FIG. 1 but shows the splice having moved slightly to the right and the further splicing tape applicator rotating so that the further splicing tape is applied to the abutting tail end and leading edge opposite to the splicing tape.

FIG. 3 is a similar view to that shown in FIG. 1 but shows the splice having moved slightly to the right and the further splicing tape applicator 32 rotating as indicated by the arrow 42 so that the splicing tape 34 is applied to the abutting tail end 12 and leading edge 16 opposite to the splicing tape 26.

Figure 4:
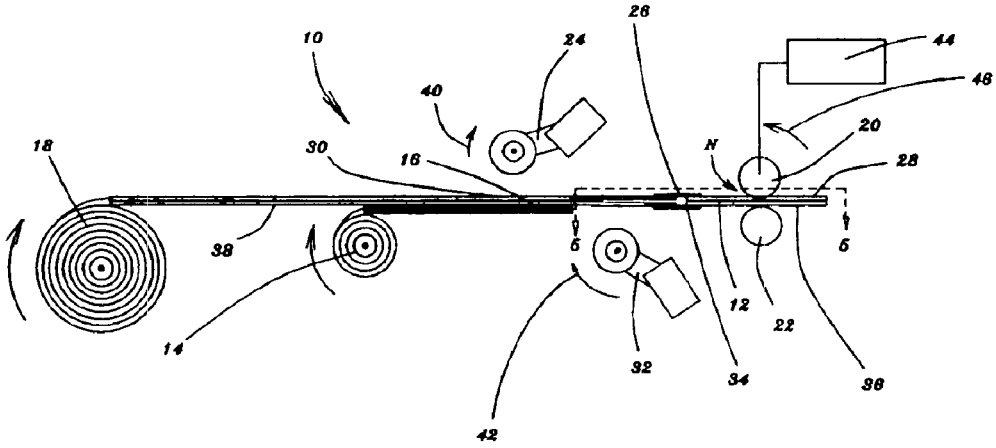
FIG. 4 is a similar view to that shown in FIG. 3 but shows the further splicing tape applicator rotating back to the location shown in FIGS. 1 and 2 and with the further splicing tape splicing the abutting tail end and leading edge and disposed on the opposite side of the splice relative to the splicing tape.

FIG. 4 is a similar view to that shown in FIG. 3 but shows the further splicing tape applicator 32 rotating, as indicated by the arrow, back to the location shown in FIGS. 1 and 2 and with the splicing tape 34 splicing the abutting tail end 12 and leading edge 16 and disposed on the opposite side of the splice relative to the splicing tape 26.

Also, as shown in FIG. 1, the sleeve label splicer apparatus 10 further includes a control mechanism 44 for controlling rotation as indicated by the arrow 46 of the drive roller 20 such that the tail end 12 and leading edge 16 are indexed relative to each other.

Figure 5:
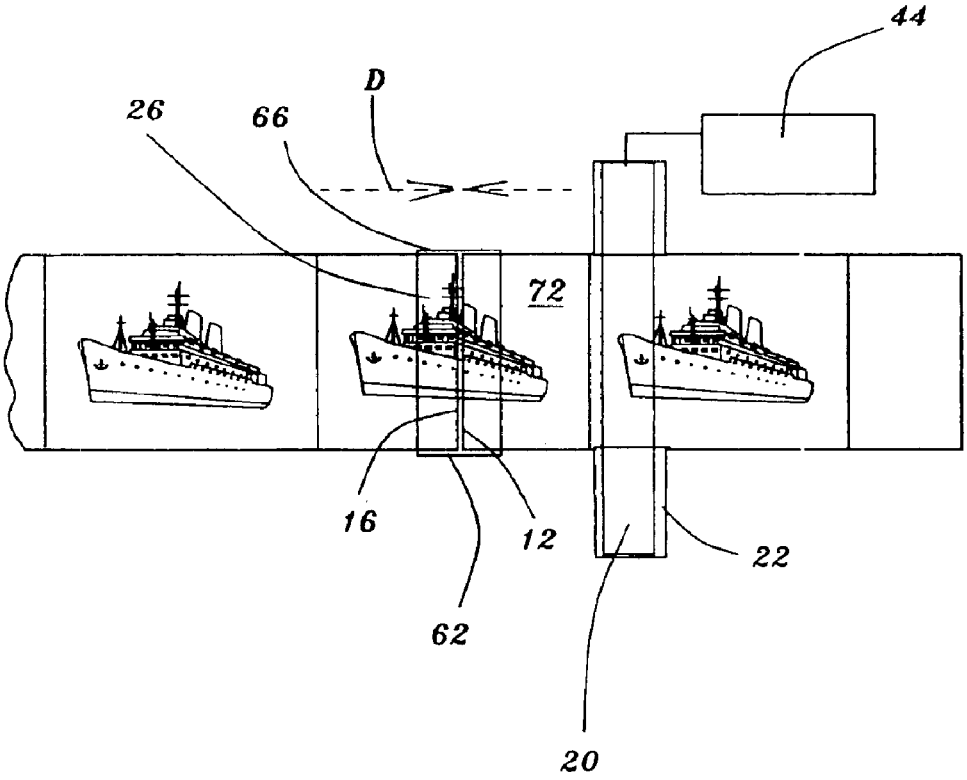
FIG. 5 is a view taken on the line 5—5 of FIG. 4.

FIG. 5 is a view taken on the line 5—5 of FIG. 4. As shown in FIG. 5, the control mechanism 44 enables indexing of the tail end 12 and leading edge 16 and rotation of the drive roller 20.

Figure 6:
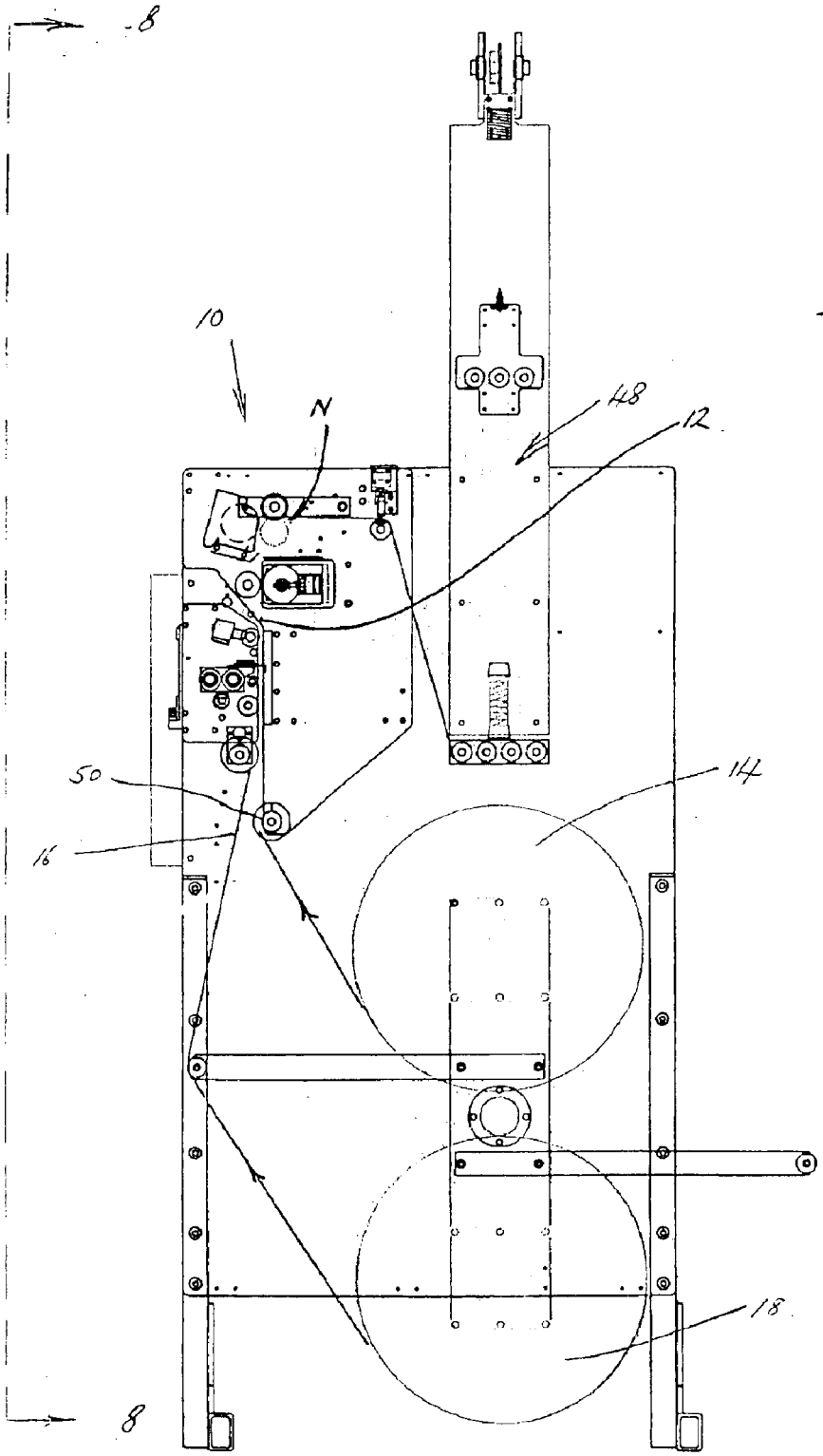
FIG. 6 is a front elevational view of a commercial embodiment of the sleeve label splicer apparatus according to the present invention.

FIG. 6 is a front elevational view of a commercial embodiment of the sleeve label splicer apparatus 10 according to the present invention. As shown in FIG. 6, the apparatus 10 also includes a festoon generally designated 48 which is disposed downstream relative to the nip N.

Figure 7:
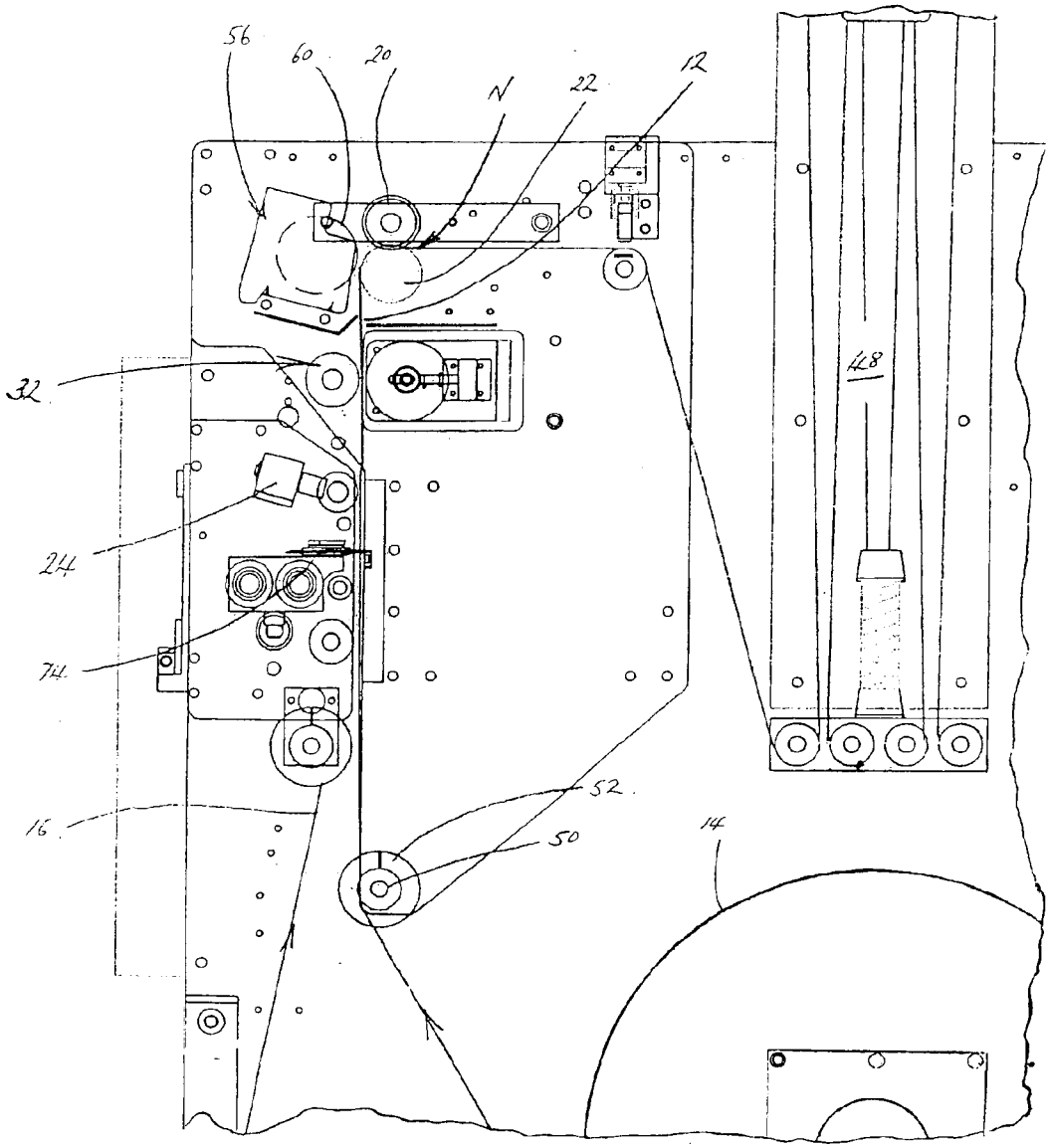
FIG. 7 is an enlarged view of the nip shown in FIG. 6.

FIG. 7 is an enlarged view of the nip N shown in FIG. 6. As shown in FIG. 7, the drive roller 20 permits the nip N to isolate any tension generated by the festoon 48 from the tail end 12 and leading edge 16 which are indexed relative to each other during application of the splicing tapes 26 and 34.

Furthermore, the tape applicator 24 is disposed upstream relative to the nip N and the further tape applicator 32 is also disposed upstream relative to the nip N. The arrangement is such that the tape applicator 24 and further tape applicator 32 apply the splicing tape 26 and further splicing tape 34 respectively substantially simultaneously to the tail end 12 and leading edge 16 which are indexed relative to each other. However, as shown in FIGS. 1–4, although the tapes 26 and 34 are applied substantially simultaneously, in fact the tape 34 is applied slightly downstream and consequently slightly later in time relative to the application of the tape 26.

As also shown in FIG. 7 an idler roller 50 is disposed in a vicinity of the tape applicators 24 and 32 for guiding the tail end 12 and leading edge 16 which are indexed relative to each other. A first clamp collar 52 is adjustably secured axially to the idler roller 50 for guiding the indexed tail end 12 and leading edge 16.

Figure 8:
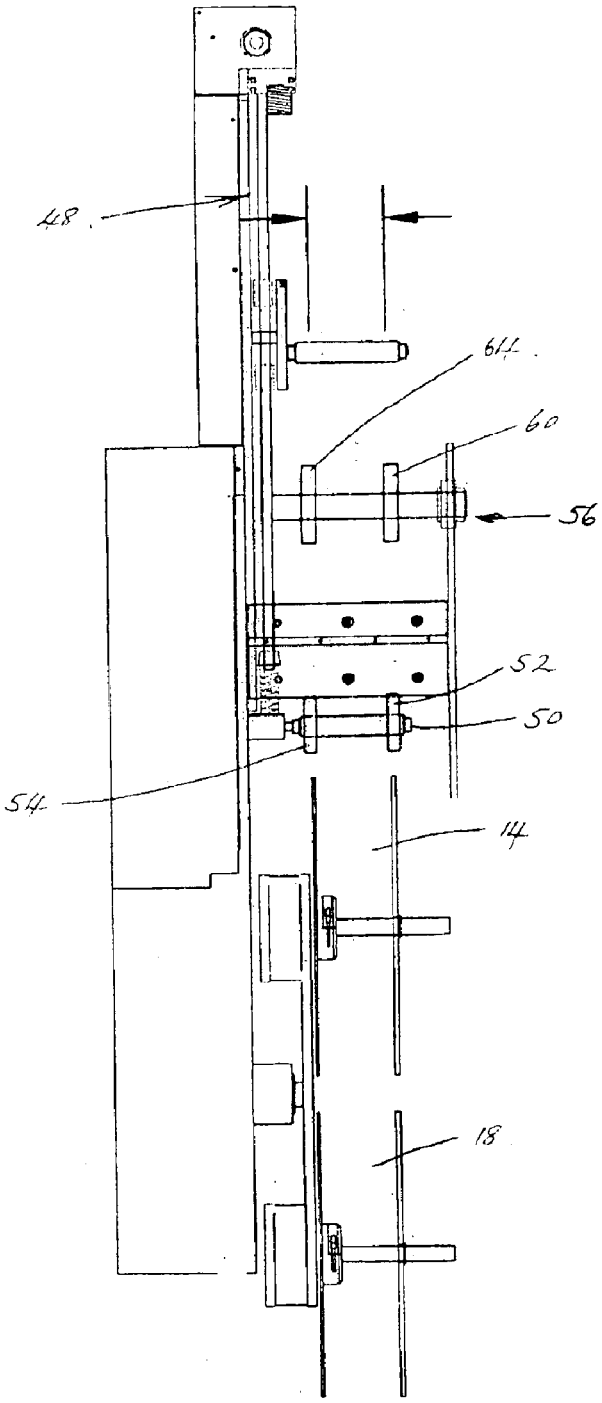
FIG. 8 is a view taken on the line 8—8 of FIG. 6.

FIG. 8 is a view taken on the line 8—8 of FIG. 6. As shown in FIG. 8, a second clamp collar 54 is adjustably secured to the idler roller 50 and spaced from the first collar 52 for guiding the indexed tail end 12 and leading edge 16.

Moreover, the idler roller 50 is disposed upstream relative to the tape applicators 24 and 32 respectively.

As shown in FIG. 7, a trimming mechanism generally designated 56 is provided for trimming excess splicing tape from the splicing tapes 26 and 34 of the abutting spliced rolls 14 and 18.

More specifically, as shown in FIG. 8, the trimming mechanism 56 includes a first trimming knife 60 for trimming a first side 62 of the applied splicing tapes 26 and 34 respectively as shown in FIG. 5 and a second trimming knife 64 is provided for trimming a second side 66 of the applied splicing tapes 26 and 34 as shown in FIG. 5.

Also, as shown in FIG. 5, the tail end 12 and leading edge 16 are indexed such that the splicing tapes 26 and 34 are applied to both the front surfaces 28 and 30 and the back surfaces 36 and 38 of one label 72 of the sleeved labels so that when the sleeved label 72 with splicing tapes 26 and 34 applied thereto is subsequently applied to a product (not shown), only the product with that sleeved label 72 applied thereto will require rejection.

In operation of the apparatus 10, when the roll of sleeve labels 14 becomes depleted, tapes 26 and 34 are prepared and positioned on applicators 24 and 32 respectively. The control mechanism 44 controls the relative location of the labels on the roll 14 and the replacement roll of labels 18 so that a label on the roll 14 is indexed with an identical label on the roll 18. A transverse shear 74, shown in FIG. 7, is then actuated in order to cut transversely across both of the indexed labels. While the drive and backing rollers 20 and 22 isolate any tension generated by the festoon 48, the tape 26 is then applied and the tape 34 is then applied. The arrangement is such that the tape 26 is applied to surfaces 28 and 30 while the tape 34 is applied to the opposite surfaces 36 and 38 of the indexed labels so that the tapes 26 and 34 splice together the rolls 14 and 18. The label with the splice applied thereto is guided by the collars 52 and 54 so that any excess tape is cut from the first and second sides 62 and 66 respectively by the trimming knives 60 and 64 respectively. Thus the tapes 26 and 34 are applied transversely across one label 72 as shown in FIG. 5. This label 72 will subsequently be applied by a sleeving mandrel (not shown) so that the label 72 with the splicing tapes 26 and 34 is slipped over a bottle or the like. In this manner, because of the applied tapes 26 and 34, it is only necessary to reject that one bottle. If on the other hand, the tapes 26 and 34 had been applied between adjacent labels, the bottle and a subsequent bottle in the production line would both have required rejection as the label and adjacent label would have tape thereon.

The present invention enables splicing of sleeved labels so that adjacent labels are no more than 1/32 of an inch apart. If a greater distance than 1/32 of an inch between spliced labels were permitted, the adhesive of tape 26 would adhere to the adhesive of tape 34 and would interfere with the opening of the sleeve label at the sleeving mandrel. Furthermore, if the sides 62 and 66 of the tapes 26 and 34 are permitted to extend by more than 1/16 inches from the spliced rolls 14 and 18, such would cause a jam of the labels at the sleeving mandrel. The present invention enables trimming to less than 1/16 of an inch of such sides 62 and 66.

The present invention provides a means for splicing sleeve labels by isolating any tension during the splicing operation.

What is claimed is:

1. A sleeve label splicer apparatus for splicing together a tail end of a roll of sleeve labels to a leading edge of a replacement roll of sleeve labels, the splicer apparatus comprising:

a drive roller for driving and guiding the roll of sleeve labels;

a backing roller cooperating with the drive roller such that the drive and backing rollers define therebetween a nip for controllably positioning the tail end of the roll of sleeve labels relative to the leading edge of the replacement roll of sleeve labels such that the tail end is disposed in abutting relationship relative to the leading edge of the replacement roll;

a splicing tape applicator for applying a splicing tape to front surfaces of the abutting tail end and leading edge;

a further splicing tape applicator for applying a further splicing tape to back surfaces of the abutting tail end and leading edge;

an idler roller disposed in a vicinity of the tape applicators for guiding the tail end and leading edge which are indexed relative to each other;

a first clamp collar adjustably secured to the idler roller for guiding the indexed tail end and leading edge; and a second clamp collar adjustably secured to the idler roller and spaced from the first collar for guiding the indexed tail end and leading edge.

2. A sleeve label splicer apparatus as set forth in claim 1 further including:

a control mechanism for controlling rotation of the drive roller such that the tail end and leading edge are indexed relative to each other.

3. A sleeve label splicer apparatus as set forth in claim 1 further including:

a festoon disposed downstream relative to the nip;

the backing roller permitting the nip to isolate any tension generated by the festoon from the tail end and leading edge which are indexed relative to each other during application of the splicing tapes.

4. A sleeve label splicer apparatus as set forth in claim 1 wherein the tape applicator is disposed upstream relative to the nip.

5. A sleeve label splicer apparatus as set forth in claim 1 wherein the further tape applicator is disposed upstream relative to the nip.

6. A sleeve label splicer apparatus as set forth in claim 1 wherein the tape applicator and further tape applicator are disposed upstream relative to the nip.

7. A sleeve label splicer apparatus as set forth in claim 6 wherein the tape applicator and further tape applicator apply the splicing tape and further splicing tape respectively substantially simultaneously to the tail end and leading edge which are indexed relative to each other.

8. A sleeve label splicer apparatus as set forth in claim 1 wherein the idler roller is disposed upstream relative to the tape applicators.

9. A sleeve label splicer apparatus as set forth in claim 1 further including:

a trimming mechanism for trimming excess splicing tape from the abutting spliced rolls.

10. A sleeve label splicer apparatus as set forth in claim 9 wherein the trimming mechanism includes;

a first trimming knife for trimming a first side of the applied splicing tapes;

a second trimming knife for trimming a second side of the applied splicing tapes.

11. A sleeve label splicer apparatus as set forth in claim 1 wherein the tail end and leading edge are indexed such that the splicing tapes are applied to both the front and back surfaces of one of the sleeve labels so that when the one sleeve label with splicing tapes applied thereto is applied to a product, only the product with the one sleeve label applied thereto will require rejection.

12. A sleeve label splicer apparatus for splicing together a tail end of a roll of sleeve labels to a leading edge of a replacement roll of sleeve labels, the splicer apparatus comprising:

a drive roller for driving and guiding the roll of sleeve labels;

a backing roller cooperating with drive roller such that the drive and backing rollers define therebetween a nip for controllably positioning the tail end of the roll of sleeve labels relative to the leading edge of the replacement roll of sleeve labels such that the tail end is disposed in abutting relationship relative to the leading edge of the replacement roll;

a splicing tape applicator for applying a splicing tape to front surfaces of the abutting tail end and leading edge;

a further splicing tape applicator for applying a further splicing tape to back surfaces of the abutting tail end and leading edge;

a control mechanism for controlling rotation of the drive roller such that the tail end and leading edge are indexed relative to each other;

a festoon disposed downstream relative to the nip;

the backing roller permitting the nip to isolate any tension generated by the festoon from the tail end and leading edge which are indexed relative to each other during application of the splicing tapes;

the tape applicator and further tape applicator being disposed upstream relative to the nip;

the tape applicator and further tape applicator applying the splicing tape and further splicing tape respectively substantially simultaneously to the tail end and leading edge which are indexed relative to each other;

an idler roller disposed in a vicinity of the tape applicators for guiding the tail end and leading edge which are indexed relative to each other;

a first clamp collar adjustably secured to the idler roller for guiding the indexed tail end and leading edge;

a second clamp collar adjustably secured to the idler roller and spaced from the first collar for guiding the indexed tail end and leading edge;

the idler roller being disposed upstream relative to the tape applicators;

a trimming mechanism for trimming excess splicing tape from the abutting spliced rolls;

the trimming mechanism including:

a first trimming knife for trimming a first side of the applied splicing tapes;

a second trimming knife for trimming a second side of the applied splicing tapes; and the tail end and leading edge being indexed such that the splicing tapes are applied to both the front and back surfaces of one of the sleeve labels so that when the one sleeve label with splicing tapes applied thereto is applied to a product, only the product with the one sleeve label applied thereto will require rejection.

* * * * *